US005970721A

United States Patent [19]

Kamimura et al.

[11] Patent Number: 5,970,721

[45] Date of Patent: Oct. 26, 1999

[54] MIXED REFRIGERANT INJECTION METHOD

[75] Inventors: Ichiro Kamimura; Norio Sawada; Kouji Satou; Tetuya Masuda, all of Oizuma-machi, Japan

[73] Assignee: Sanyo Electric Co., Ltd., Osaka, Japan

[21] Appl. No.: 08/870,187

[22] Filed: Jun. 6, 1997

[30] Foreign Application Priority Data

Jun. 10, 1996 [JP] Japan ..... 8-170559

[51] Int. Cl.[6] ..... F25B 45/00

[52] U.S. Cl. ..... 62/77; 62/292

[58] Field of Search ..... 62/77, 122, 114, 62/292, 502

[56] References Cited

U.S. PATENT DOCUMENTS

| | | | |
|---|---|---|---|
| 3,668,882 | 6/1972 | Sarsten et al. | 62/77 |
| 4,106,306 | 8/1978 | Saunders | 62/149 |
| 4,722,195 | 2/1988 | Suzuki et al. | 62/149 |
| 5,140,827 | 8/1992 | Reedy | 62/174 |
| 5,172,562 | 12/1992 | Manz et al. | 62/149 |
| 5,709,093 | 1/1998 | Ceri et al. | 62/77 |
| 5,711,158 | 1/1998 | Yoahida et al. | 62/77 |

FOREIGN PATENT DOCUMENTS

| | | | |
|---|---|---|---|
| 0 271 429 | 1/1987 | European Pat. Off. | F25B 45/00 |
| 38 00 5 A1 | 4/1988 | Germany | F25B 45/00 |

*Primary Examiner*—John M. Sollecito
*Attorney, Agent, or Firm*—Darby & Darby

[57] ABSTRACT

In a method and an apparatus for injecting mixed refrigerant into a refrigerant circuit comprising at least a compressor, a condenser, an expansion device and an evaporator which are connected to one another through a refrigerant pipe, the mixed refrigerant is intermittently injected from a refrigerant bomb at a predetermined position of a low pressure side of the refrigerant circuit while keeping the mixed refrigerant in a liquid state. The intermittent injection operation (amount) of the liquid refrigerant into the refrigerant circuit may be controlled on the basis of the degree of superheat of the mixed refrigerant in the refrigerant circuit.

10 Claims, 6 Drawing Sheets

MIXED REFRIGERANT INJECTION METHOD

BACKGROUND OF THE INVENTION

1. Field of the Invention

The present invention relates to a method for injecting mixed refrigerant (in the following description, the mixed refrigerant is defined as a mixture of at least two or more kinds of refrigerants, and for example, it is commonly named R-410A, R-407C or the like. It is hereinafter merely referred to as "refrigerant") into a refrigerant circuit comprising at least a compressor, a condenser, an expansion device and an evaporator which are connected to one another through a refrigerant pipe while keeping the refrigerant to be injected in a liquid state, and more particularly to a method for injecting a liquid refrigerant while preventing the refrigerant from being compressed under the liquid state (hereinafter referred to as "compression under liquid") in a compressor.

2. Description of Related Art

There has been known a refrigerating machine such as a separation type air conditioner, a show-case or prefabricated type refrigerator (freezer) or the like in which various elements constituting a refrigerant circuit are installed while these elements are shared to and disposed in an indoor unit and an outdoor unit respectively. When the indoor unit and the outdoor unit of such a refrigerating machine are connected to each other to make the refrigerant circuit works effectively, the length of a pile through which the indoor and outdoor units are connected varies in accordance with the set-up places of these units. If the indoor or outdoor unit is set up in such a place as to increase the length of the refrigerant pipe, the amount of refrigerant which is beforehand filled in the refrigerant circuit (in a heat exchanger of the outdoor unit) before the indoor and outdoor units are set up would become insufficient. Therefore, the fill amount of the refrigerant is required to be varied in accordance with the length of the pipe.

Further, in various refrigerating machines containing not only the above type refrigerating machine, but also a private type room air conditioner, which need a pipe connection work for connecting the indoor and outdoor units at a set-up place, there may be occur the case where the refrigerant filled and sealed in the refrigerant circuit may gradually leak from the refrigerant circuit due to failure of the pipe connection work or the like in the progress of the operation of the refrigerating machine after set up. In this case, the injection (supplement) of the refrigerant into the refrigerant circuit is needed to prevent reduction in refrigerating capacity (power).

When refrigerant is filled (injected) into a refrigerant circuit, particularly when single refrigerant is injected into a refrigerant circuit, a desired amount of refrigerant is generally sucked under a gaseous state from a service port of the refrigerant circuit (in general, from the position which is at the upstream side of the compressor and at a low pressure position in the refrigerant circuit) by the negative pressure which is produced through the operation of the compressor while measuring the weight of a refrigerant filling (injecting) bomb, and then the refrigerant filling (injecting) work is finished when the weight of the bomb is reduced by a desired fill (injection) amount.

Recently, substitute refrigerant (HFC mixed refrigerant) such as R-407C, R-410A or the like has been frequently used to prevent the environmental destruction of the ozone layer by CFCs (Chlorofluorocarbons). However, it has been impossible to inject the mixed refrigerant into the refrigerant circuit while keeping the mixed refrigerant under a gaseous state. For example, R-407C is non-azeotropic mixed refrigerant having the following composition: HFC32:HFC125:HFC134=23 wt %:25 wt %:52 wt %, and the composition of R-407C varies when it is vaporized. Therefore, when the non-azeotropic mixed refrigerant is injected into the refrigerant circuit, it is required to inject the mixed refrigerant into the refrigerant while keeping the mixed refrigerant under a liquid state.

In general, the service port of the refrigerant circuit is formed at the refrigerant suck-in side of the compressor. Therefore, when the liquid refrigerant whose amount exceeds the liquid refrigerant capacity of an accumulator is injected from the service port into the refrigerant circuit, the liquid refrigerant is directly sucked into the compressor, and the refrigerant is compressed under the liquid state (i.e., the liquid-compression occurs) in the compressor, resulting in failure of the compressor. Here, the liquid refrigerant capacity of the accumulator is defined as the permissible maximum refrigerant amount which can be stocked in the accumulator so that the liquid refrigerant moves from the accumulator to the compressor (i.e., no liquid-compression occurs in the compressor).

In the case of a relatively compact type refrigerating machine (refrigerator or the like) having no accumulator, the liquid-compression problem as described above would occur if liquid refrigerant is injected so that the injection amount thereof exceeds the natural vaporization amount thereof in a refrigerant pile of the refrigerant circuit.

SUMMARY OF THE INVENTION

An object of the present invention is to provide a method for quickly injecting mixed refrigerant into a refrigerant circuit while preventing the liquid-compression of refrigerant in a compressor.

In order to attain the above object, according to a first aspect of the present invention, a method for injecting mixed refrigerant into a refrigerant circuit comprising at least a compressor, a condenser, an expansion device and an evaporator which are connected to one another through a refrigerant pipe, is characterized in that the mixed refrigerant is intermittently injected from a refrigerant bomb at a predetermined injection position of a low pressure side of said refrigerant circuit while keeping the mixed refrigerant in a liquid state.

According to the mixed refrigerant injecting method, the average injection amount of the liquid refrigerant into the refrigerant circuit is adjusted to suppress the liquid compression in the compressor.

In the mixed refrigerant injection method as described above, the refrigerant circuit contains an accumulator which is provided between the suction port of the compressor and the predetermined injection position, and the intermittent injection amount of the mixed refrigerant is set to be lower than the liquid stock capacity of the accumulator and determined on the basis of a refrigerant vaporizing capability of the mixed refrigerant.

According to the above method, the injection amount of the liquid refrigerant into the refrigerant circuit can be set to be lower than the liquid stock capacity of the accumulator and also within the liquid vaporizing capability of the accumulator. Therefore, the liquid compression in the compressor can be suppressed.

Further, in the mixed refrigerant injection method, the average injection velocity of the mixed refrigerant is set to such a suitable value that the average injection velocity does not exceed the vaporization velocity of the mixed refrigerant based on the environmental temperature.

According to the above method, even when the vaporizing capability of the liquid refrigerant in the accumulator is varied due to the effect of the environmental temperature, the variation of the vaporizing capability can be applied to the injection amount control, so that the liquid compression in the compressor can be more greatly suppressed.

In the mixed refrigerant injection method as described above, the average injection velocity of the mixed refrigerant which is intermittently injected to the predetermined position in the refrigerant circuit is determined on the basis of the degree of superheat of the refrigerant in the refrigerant circuit.

In the mixed refrigerant injection method as described above, the degree of superheat of the mixed refrigerant is defined as (1) the difference between the temperature of the mixed refrigerant discharged from the compressor and the saturation temperature of the mixed refrigerant which is calculated on the basis of the pressure of the mixed refrigerant discharged from said compressor, (2) the difference between the temperature of the mixed refrigerant discharged from the compressor and the condensation temperature of the mixed refrigerant which is calculated on the basis of the outside air temperature, (3) the difference between the temperature of the mixed refrigerant sucked into the compressor and the saturation temperature of the mixed refrigerant sucked into the compressor which is calculated on the basis of the pressure of the mixed refrigerant sucked into said compressor, (4) the difference between the temperature of the mixed refrigerant sucked into the compressor and the temperature of the mixed refrigerant sucked into the compressor which is calculated on the basis of the outside air temperature, (5) the difference between the temperature of the case of the compressor and the saturation temperature of the mixed refrigerant which is calculated on the basis of the pressure of the mixed refrigerant discharged from the compressor, (6) the difference between the temperature of the case of the compressor and the condensation temperature of the mixed refrigerant which is calculated on the basis of the outside air temperature (in the case where said compressor is a high internal pressure type), (7) the difference between the temperature of the case of the compressor and the saturation temperature of the mixed refrigerant which is calculated on the basis of the pressure of the mixed refrigerant sucked into the compressor, or (8) the difference between the temperature of the case of the compressor and the temperature of the mixed refrigerant sucked into the compressor which is calculated on the outside air temperature (in the case of a low internal pressure type compressor).

According to the above methods, the possibility of the liquid compression in the compressor can be judged on the basis of the degree of superheat of the mixed refrigerant in the refrigeration cycle. Accordingly, the injection time of the mixed refrigerant can be shortened while maximizing the injection amount of the liquid refrigerant. In addition, the liquid compression in the compressor can be more accurately prevented. The degree of superheat can be easily calculated on the basis of the difference between the temperature of the mixed refrigerant and the saturation temperature thereof which is calculated from the measured pressure of the mixed refrigerant, or the like.

According to a second aspect of the present invention, a mixed refrigerant injecting apparatus for injecting mixed refrigerant into a refrigerant circuit comprising at least a compressor, a condenser, an expansion device and an evaporator which are connected to one another through a refrigerant pipe, comprises liquid refrigerant stock means for stocking liquid refrigerant, weighing means for weighing the liquid refrigerant stock means to detect the reduced amount of the liquid refrigerant in the liquid refrigerant stock means, valve means for intermittently injecting the liquid refrigerant from the liquid refrigerant stock means into the refrigerant circuit, sensing means for monitoring the temperature and pressure of the refrigerant in the refrigerant; and control means for controlling the valve means to intermittently inject the liquid refrigerant into the refrigerant circuit on the basis of various information from the weighing means and the sensing means.

According to the mixed refrigerant injecting apparatus as described above, the liquid refrigerant can be injected into the refrigerant circuit with no occurrence of liquid compression in the compressor.

DETAILED DESCRIPTION OF THE PREFERRED EMBODIMENTS

Preferred embodiments according to the present invention will be described hereunder with reference to the accompanying drawings.

Figure 1:
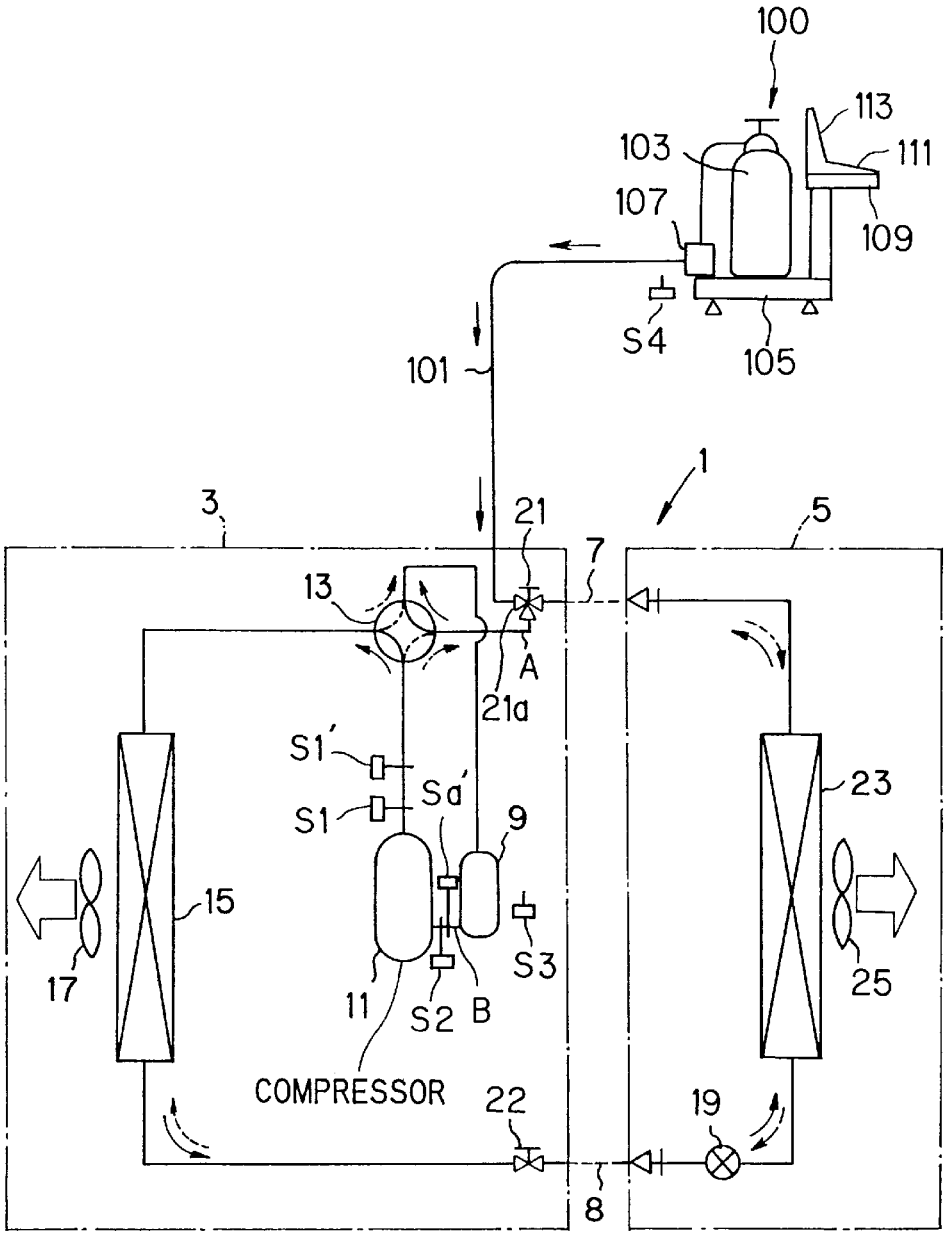
FIG. 1 is a diagram showing the whole construction of a refrigerant circuit with a liquid refrigerant injecting apparatus according to the present invention.

Fig. 1 shows a refrigerant circuit of a refrigerating machine (for example, a refrigerant circuit of an air conditioner). In FIG. 1, the air conditioner 1 comprises an outdoor unit 3 and an indoor unit 5, and the outdoor and indoor units 3 and 5 are connected to each other through a pair of refrigerant pipes 7 and 8. The outdoor unit 3 contains an accumulator 9 (having a temperature sensor S3 for detecting the environmental temperature of the accumulator) for separating gaseous refrigerant and liquid refrigerant circulating in the refrigerant circuit from each other and stocking the liquid refrigerant, a compressor 11 (having a temperature sensor S1 and a pressure sensor S1' for each detecting the temperature and pressure of refrigerant discharged from the compressor 11 respectively, and a temperature sensor S2 and a pressure sensor S2' for detecting the temperature and pressure of refrigerant sucked into the compressor 11 respectively) for compressing the gaseous refrigerant from the accumulator, a four-way change-over valve 13, an outdoor heat exchanger 15 for performing heat exchange between the outdoor air and the refrigerant in the refrigerant circuit, a fan 17 for blowing out the heat-exchanged air to the outside to promote the heat exchanging operation of the outdoor heat exchanger 15, a three-way change-over valve 21 (the valve 21 serves as a closing valve at the gas side, and the intercommunication position of the valve 21 is varied by a spindle operation. Normally, the refrigerant pipe 7 is set to intercommunicate with a refrigerant pipe A through the three-way change-over valve 21), an open/dose valve 22 (the valve 22 serves as a close valve at the liquid side, and it is opened by a spindle operation in normal operation after the set-up work of the air conditioner is completed, etc. The indoor unit 5 contains an indoor heat exchanger for performing heat exchange between the indoor air and the refrigerant in the refrigerant circuit, an expansion valve 19, a fan 25 for blowing out the heat-exchanged air into the room to promote the heat exchange operation of the indoor heat exchanger, etc.

Accordingly, the elements constituting the refrigerant circuit are shared to the indoor unit 3 and the outdoor unit 5 and installed into the respective units 3 and 5.

Under operation, the refrigerant is circulated in a direction indicated by arrows of solid lines (under cooling operation) or in a direction indicated by arrows of broken lines (under heating operation) in accordance with the switching state of the four-way change-over valve 13 to perform the cooling operation or the heating operation.

Under cooling operation, the following refrigeration cycle is established. That is, the refrigerant discharged from the compressor 11 is condensed in the outdoor heat exchanger 15, and then the pressure of the refrigerant is reduced by the expansion valve 19. Thereafter, the pressure-reduced refrigerant is vaporized in the indoor heat exchanger 23, and the cooling operation is performed by the endothermic action when the refrigerant is vaporized in the indoor heat exchanger 23. On the other hand, under heating operation, the following refrigeration cycle is established. That is, the refrigerant discharged from the compressor 11 is condensed in the indoor heat exchanger 23, and then the pressure of the refrigerant is reduced by the expansion valve 19. Therefore, the pressure-reduced refrigerant is vaporized in the outdoor heat exchanger 15, and the heating operation is performed by the heat-radiation action when the refrigerant is condensed in the indoor heat exchanger 23.

According to this embodiment, when the mixed refrigerant is injected into the refrigerant circuit, a charge hose 101 of a refrigerant injection apparatus 100 is linked to a service port 21*a* of the three-way change-over valve 21, and liquid refrigerant in the refrigerant injection apparatus 100 is sucked into the refrigerant circuit by the compressor 11.

Figure 2:
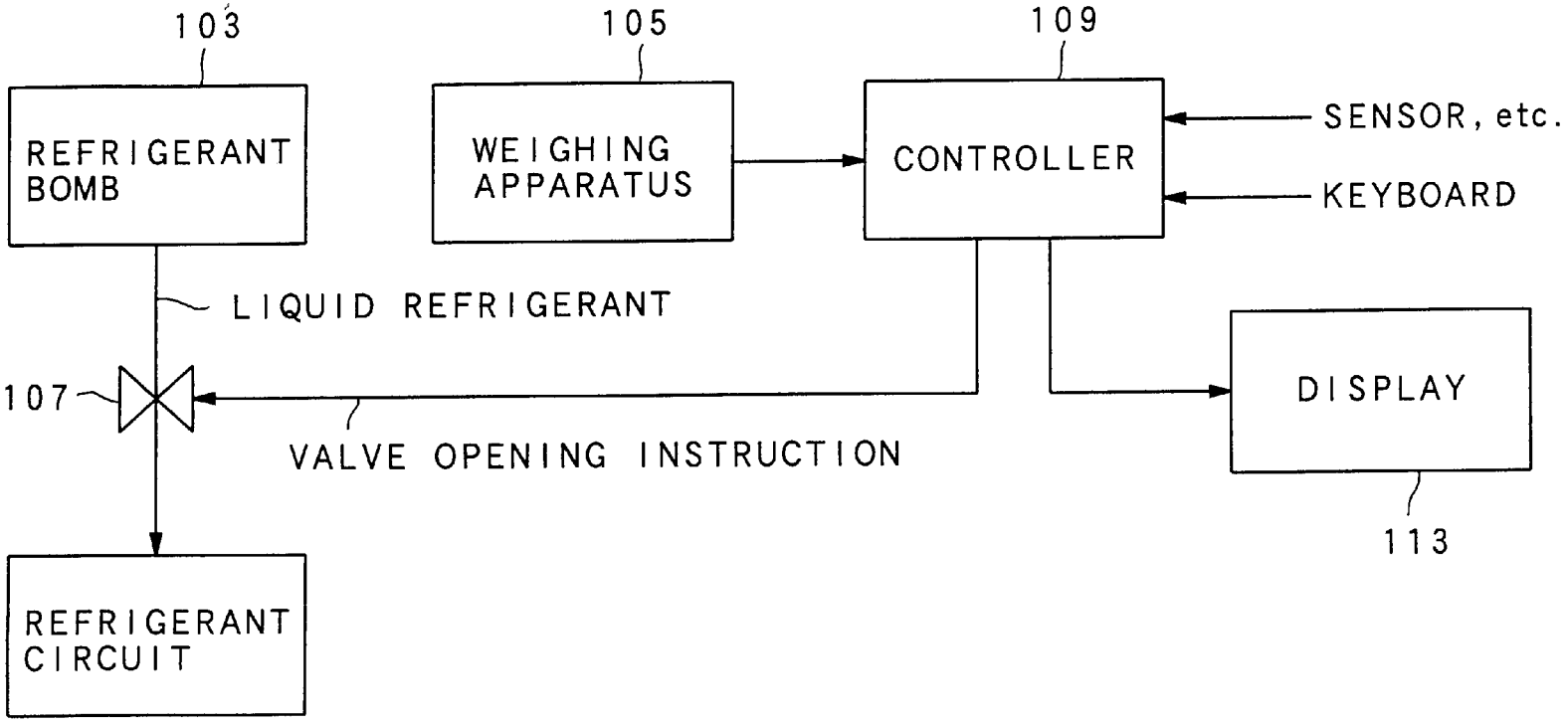
FIG. 2 is a block diagram showing the liquid refrigerant injecting apparatus shown in FIG. 1.

FIG. 2 is a block diagram showing the refrigerant injection apparatus 100. As shown in FIGS. 1 and 2, the refrigerant injection apparatus 100 comprises a refrigerant bomb 103 for stocking high-pressure refrigerant, a weighing apparatus 105 for detecting the weight of the refrigerant bomb 103, an electromagnetic cutoff valve 107 which is provided between the refrigerant bomb 103 and the charge hose 101, and temperature sensor S4 for detecting the environmental temperature of the refrigerant injection apparatus 100, and a controller 109 serving as refrigerant injection control means which controls the refrigerant injection apparatus 100. An electric cutoff valve or the like may be used in place of the electromagnetic cutoff valve 107.

The refrigerant bomb 103 comprises a cylindrical pressure container, and a siphon tube (not shown) is extended in the neighborhood of the bottom portion of the refrigerant bomb 103 in order to inject the mixed refrigerant into the refrigerant circuit while keeping the mixed refrigerant under the liquid state. Liquefied mixed refrigerant (R-407C, R-410A or the like) having the same composition as the refrigerant in the refrigerant circuit is filled in the refrigerant bomb 103, and the injection amount of the refrigerant is weighed at any time by the weighing apparatus during the refrigerant injection operation.

The controller 109 comprises a CPU, an input/output interface, a ROM, a RAM, etc., and a keyboard 111, a display 113, etc. are provided at the upper side of the controller 109. The input interface of the controller 109 are supplied with weight information from the weighing apparatus 105, temperature information from the temperature sensors S1 to S4, pressure sensors S1' and S2', and items of the air conditioner 1, a desired refrigerant injection amount, etc. which are input from the keyboard 111 by an operator. Further, a valve-opening instruction is output from the output interface of the controller 109 to the electromagnetic cutoff valve 107, and information on a working status, etc. is output from the output interface of the controller 109 to the display 113.

Figure 3:
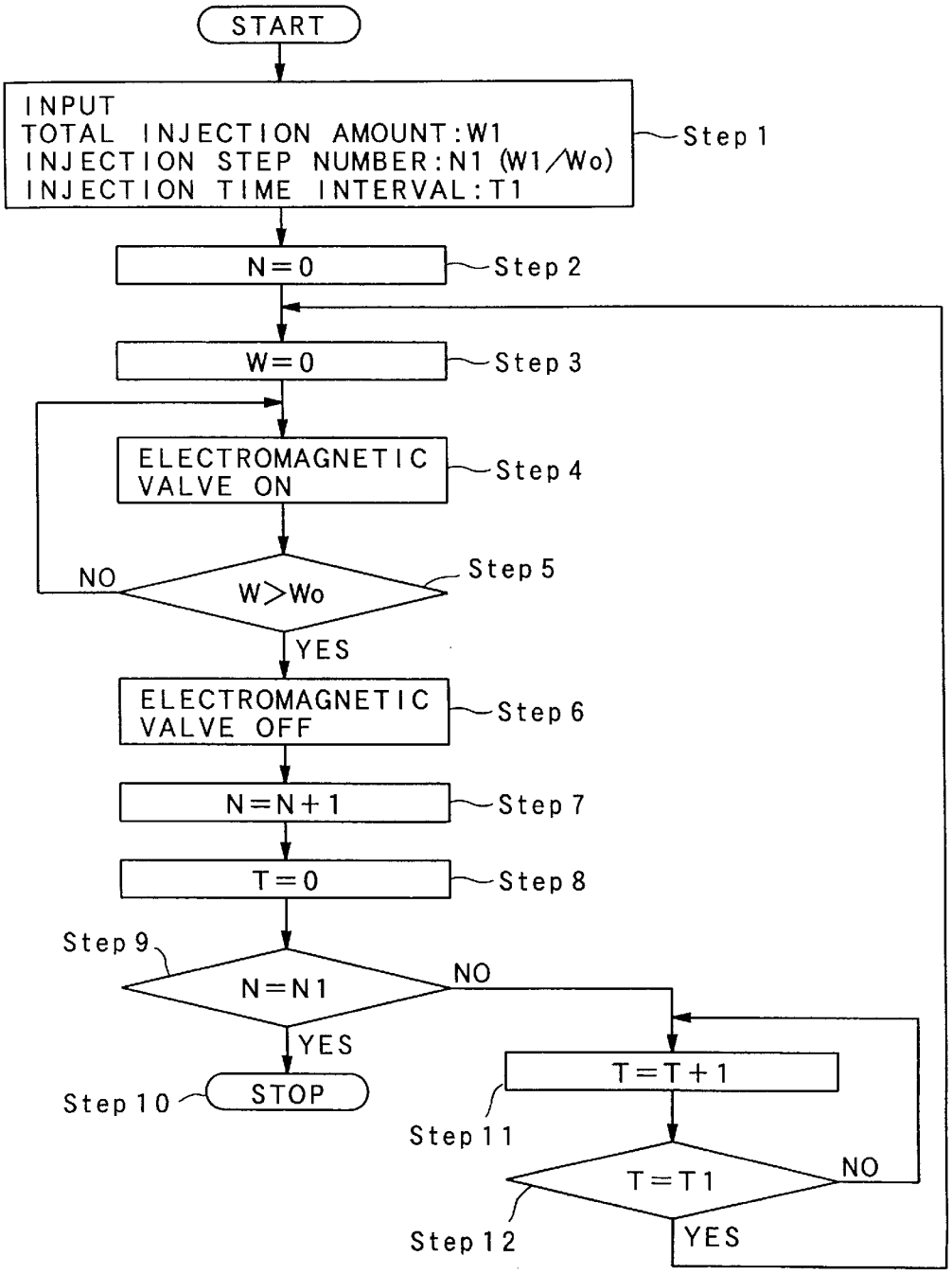
FIG. 3 is a flowchart showing an injection amount control operation according to a first embodiment of the present invention.

FIG. 3 is a flowchart showing a refrigerant injection amount control operation of the controller 109 according to a first embodiment of the present invention.

In the flowchart shown in FIG. 3, after the operator links the charge hose 101 to the service port 21*a* to inject the liquid refrigerant into the refrigerant circuit, the operator first inputs a refrigerant fill amount (total refrigerant injection amount) W1, the total injection step number (the number of injection steps) N1 and an injection time interval (injection interrupting time) T1 which are calculated from the capacity of the compressor 11, the capacity of the accumulator 9, demanded refrigerant injection amount (the deficient amount of refrigerant which is calculated from the actual operating status, that is, the actual driving power, etc. of the refrigeration circuit 1, or the deficient amount of refrigerant which is calculated on the basis of extra length when the refrigerant pipe is set to be longer than a prescribed value by the extra length), etc. In this embodiment, the liquid-refrigerant injecting operation must be divided into plural injection steps because of the restriction of the capacity of the accumulator (i.e., in order to prevent the liquid compression in the compressor), and the total injection step number is defined as the number of the injection steps which is required so that the total injection amount of the liquid-refrigerant filled in the respective injection steps is equal to the demanded refrigerant injection amount W1). Further, the injection time interval T1 is defined as the time between the injection steps.

The total injection step number N1 may be calculated according to (the total injection amount W1)/(the injection amount per injection step Wo).

In this case, if the specifications of various kinds of refrigeration circuits (the capacity of the compressor 11, the capacity of the accumulator, etc.) are beforehand stored in the ROM, the refrigerant total injection amount W1the total injection step number N1 and the injection time interval T1 can be automatically calculated by manually inputting the model type number of the refrigeration circuit 1 and the demanded injection amount (it may be the length of the refrigerant pipe when the refrigerant is deficient because the refrigerant pipe is designed to be longer), so that a number of input work steps can be omitted. Further, when the demanded refrigerant injection amount is necessarily determined from the specification of the air conditioner, the input work steps can be omitted by inputting the model type number.

Upon receiving the input information from the keyboard 111 or the like, a time schedule is set in a storage unit of the controller 109 on the basis of the input information and data in the ROM. The time schedule contains various information such as a liquid-refrigerant injection (feeding) time t1 which corresponds to the injection time of each injection step and is needed to inject the liquid refrigerant until the injection amount of the liquid refrigerant reaches an injection amount Wo of the liquid refrigerant per injection step, the injection time interval (i.e., injection-interrupting time) T1 and the total injection step number N1 (the number of injection steps of the liquid refrigerant in the injection operation)). For example, the liquid-refrigerant injection time t1 is set on the basis of the liquid-refrigerant injection amount per injection step (W0) which is determined by the capacity of the accumulator 9 and the refrigerant supply permissible (maximum) amount per unit time (determined by the pressure in the refrigerant bomb 103 and the liquid-refrigerant flowing amount of the electromagnetic cutoff valve 107 and the charge hose 101), the injection time interval T1 is set on the basis of the capacity of the accumulator 9 and the vaporization velocity of the liquid refrigerant, and the total injection step number N1 is set on the basis of the demanded refrigerant injection amount (W1) and the injection amount per injection step (W0) (i.e., N1=W1/W0) (step 1).

After the setting of the time schedule is completed, the controller 109 controls the display 113 to display the time schedule and the completion of the preparation process thereon. According to this embodiment, the temperature information output from the temperature sensor S3 for detecting the environmental temperature of the accumulator 9 or the temperature sensor S4 for detecting the environmental temperature of the refrigerant injecting apparatus 100 is used for the setting of the time schedule.

For example, under the summer season, the injection time interval must be set to be shorter because the pressure in the refrigerant circuit rises up and the vaporization velocity of the liquid refrigerant in the accumulator 9 also increases under the summer season. On the other hand, under the winter season, the injection time interval must be set to be longer because the above conditions are inverted under the winter season.

Figure 4:
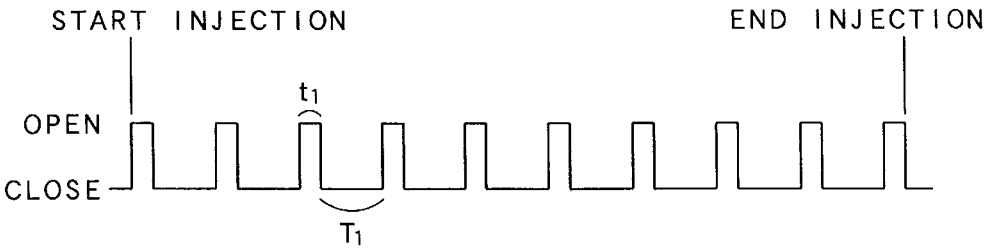
FIG. 4 is a time schedule in the injection amount control operation shown in FIG. 3.

FIG. 4 shows an example of the time schedule. In this case, the injection time t1 and the injection time interval T1 are set to 3 minutes and 10 minutes respectively as shown in FIG. 4. Further, the total injection step number N1 is set to 10, and the target injection (filling) amount of the liquid refrigerant (for example, 10 kg) can be injected by repeating the refrigerant injection step at ten times. If on the basis of the input information from the weighing apparatus 105 the controller 109 recognizes that the amount of the liquid refrigerant stocked in the refrigerant bomb 103 is smaller than the demanded injection amount, the controller 109 instructs the display 113 to display the deficiency of the liquid refrigerant and also instructs a sound alarm to outputs an alarm sound.

The operator who checks the display of the completion of the set-up on the display 113 operates the three-way change-over valve 21 to link the charge hose 101 to the refrigerant pipe a, then starts the cooling operation of the refrigeration circuit 1, and then operates to start the driving of the refrigerant injecting apparatus 100. In response to this operation, the controller 109 opens or doses the electromagnetic cutoff valve 107 according to the time schedule shown in FIG. 4 to inject the liquid refrigerant from the refrigerant bomb 103 into the refrigerant circuit. In this case, the injection amount of the liquid refrigerant per unit time may vary in accordance with reduction of the pressure of the refrigerant bomb 103 or variation of the environmental temperature.

Subsequently, in step 2 and step 3, a variable N and a variable W are set to "0" as initial values (N represents the number of the current injection step, and W represents the current injection amount of the refrigerant). At this time, the refrigerant is circulated in the direction of the arrows of the solid lines in the refrigerant circuit, and at the same time the electromagnetic cutoff valve 107 is opened (step 4) to inject the liquid refrigerant from the refrigerant injecting apparatus 100 through the three-way change-over valve to a predetermined position at the low-pressure side in the refrigerant circuit.

The injected refrigerant flows into the accumulator 9 and is stocked therein so that it is prevented from reaching the compressor 11 at the downstream side of the accumulator. In step 4, it is judged whether the injection amount W of the liquid refrigerant exceeds the injection amount W0. If W exceeds Wo, the process goes to step 6 to close the electromagnetic cutoff valve 107. On the other hand, if W does not exceed Wo, the process returns to the step 4 to continue the injection of the liquid refrigerant. The injection amount W of the liquid refrigerant is measured by weighting the refrigerant bomb 103 with the weighing apparatus 105. Accordingly, the liquid refrigerant can be prevented from being excessively injected into the accumulator, and thus the overflow of the liquid refrigerant from the accumulator 9 can be prevented.

Subsequently, in step 7, the number of the injection step (N) is incremented by "1", and in step 8 the value t of a timer for counting the injection time interval is set to "0" as an initial value.

In step 9, it is judged whether the injection step number N is equal to the total injection step number N1. If N=N1, the liquid refrigerant injection is finished in step 10.

On the other hand, if N is not equal to N1 in step 9, the process goes to steps 11 and 12 to keep the electromagnetic cutoff valve 10 to be closed to interrupt the injection of the liquid refrigerant while repetitively incrementing the value T of the timer by "1" until the value T of the timer reaches T1. During the interruption time (T1 ), the liquid refrigerant in the accumulator 9 is gradually vaporized and sucked into the compressor 11, and finally no liquid refrigerant exists in the accumulator 9.

If T=T1 is judged in step 12, the process returns to the step 3 to open the electromagnetic cutoff valve 107 again by the controller 109, thereby reopening the injection of the liquid refrigerant into the accumulator 9.

When the liquid refrigerant injection is carried out at the predetermined number of times and thus it is completed, the controller 109 controls the display 113 to display the completion of the liquid refrigerant injecting operation thereon, and also controls the sound alarm to outputs an alarm sound. In this case, if on the basis of the input information from the weighing apparatus 105 the controller 109 recognizes that the liquid refrigerant stocked in the refrigerant bomb 103 is too deficient to fill the target amount of the liquid refrigerant in the refrigerant circuit, the controller 109 controls the display 113 to display the deficiency of the liquid refrigerant before the injection work is started. Further, if on the basis of the input information from the weighing apparatus 105 the controller 109 recognizes that the total injection amount of the liquid refrigerant reaches the target injection amount in the course of the refrigerant injection work, the controller 109 stops the injection work of the liquid refrigerant and also controls the sound alarm to output the alarm sound.

According to the above-described embodiment, the liquid-refrigerant injection amount per injection step (Wo) is beforehand calculated and then the intermittent injection control of the liquid refrigerant from the refrigerant injecting apparatus 100 into the refrigerant circuit is performed on the basis of Wo. In this case, the liquid-refrigerant injection amount per injection step may be automatically determined in accordance with the degree of superheat of the refrigerant in the refrigeration cycle.

Figure 5:
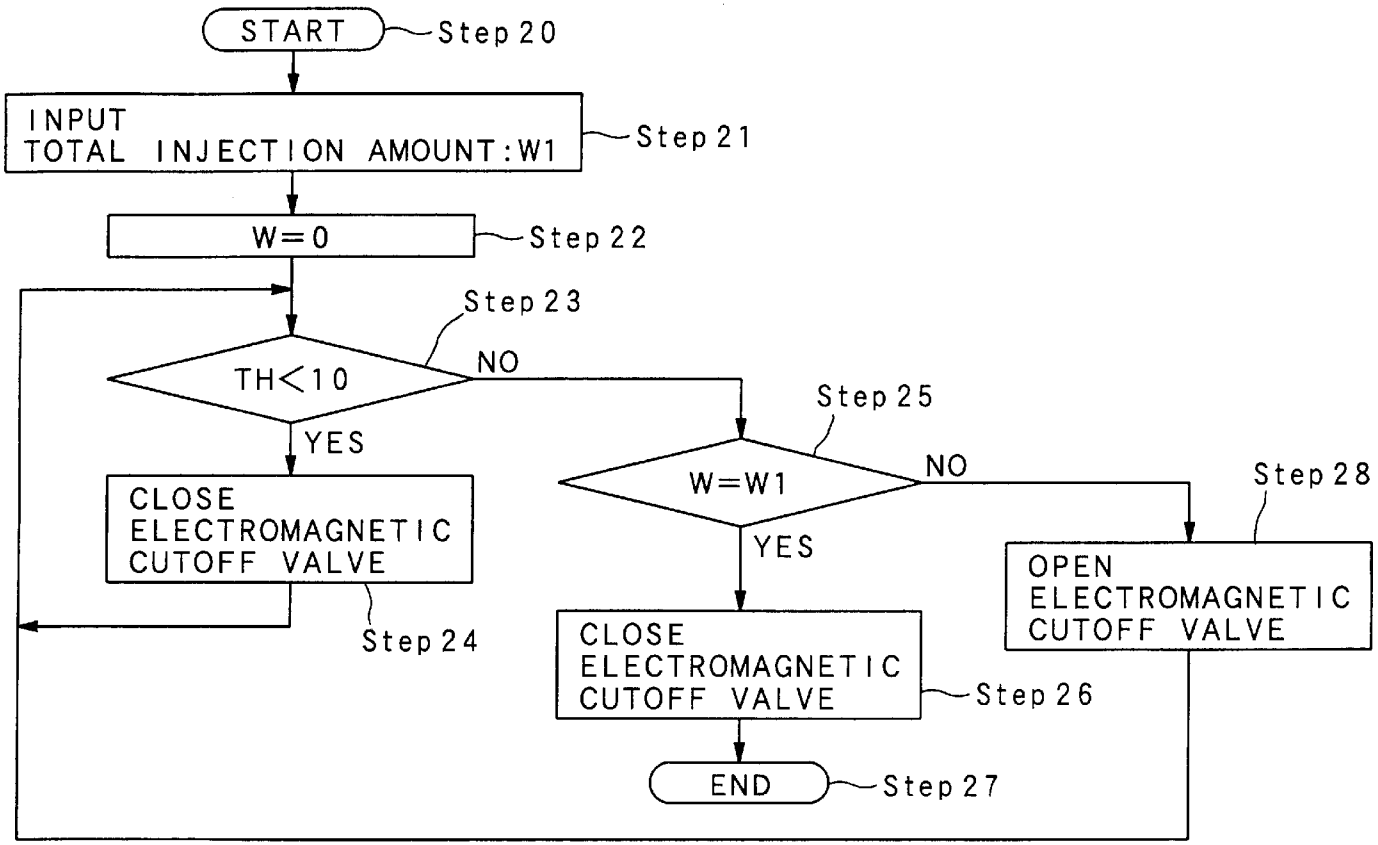
FIG. 5 is a flowchart showing an injection amount control operation based on the degree of superheat according to a second embodiment of the present invention.

FIG. 5 is a flowchart showing a refrigerant injection amount control operation when the liquid-refrigerant injection amount per injection step (Wo) is varied on the basis of the degree of superheat, according to a second embodiment of the presents invention.

First, upon start of the operation in step 20, the total injection amount W1 of the liquid refrigerant is input to the controller 109 in step 21 as in the case of the first embodiment. Subsequently, the injection of the liquid refrigerant is started in accordance with the display on the display 113.

First, the injection amount W of the liquid refrigerant is set to "0"as an initial value in step 22. Subsequently, it is judged in step 23 whether the degree of superheat TH of the refrigerant discharged from the compressor 11 is lower than a predetermined threshold value (10° C.). The degree of superheat TH corresponds to the temperature difference between the temperature of the refrigerant discharged from the compressor 11 (i.e., the temperature detected by the temperature sensor S1) and the saturation temperature of the refrigerant which is calculated on the basis of the pressure of the refrigerant discharged from the compressor 11 (i.e., the pressure detected by the pressure sensor S1). If the degree of superheat TH is lower than 10° C., the refrigerant in the compressor is kept under a wet compression state, and thus there is such a risk that the liquid compression would occur in the compressor.

The threshold value (10° C.) may be corrected to the optimum value in accordance with the design condition of the refrigerant circuit, the environmental temperature condition, etc. If the judgment in step 23 is "YES", the process goes to step 24 to dose the electromagnetic cutoff valve 107 and stop the injection of the liquid refrigerant. On the other hand, if the judgment in step 23 is "NO", the process goes to step 25 to judge whether W =W1. If W=W1 in step 25, the process goes to step 26 to dose the electromagnetic cutoff valve 107, and the injection control operation of the liquid refrigerant is finished.

If the judgment in step 25 is "NO", the process goes to step 28 to open the dosed electromagnetic cutoff valve 107 and reopen the injection of the liquid refrigerant, and then the process returns to step 23 to repeat the above operation.

Through the above operation, the injection of the liquid refrigerant can be performed in the minimum time while keeping the degree of superheat of the refrigeration cycle to a suitable value which is above the predetermined threshold value.

Figure 6:
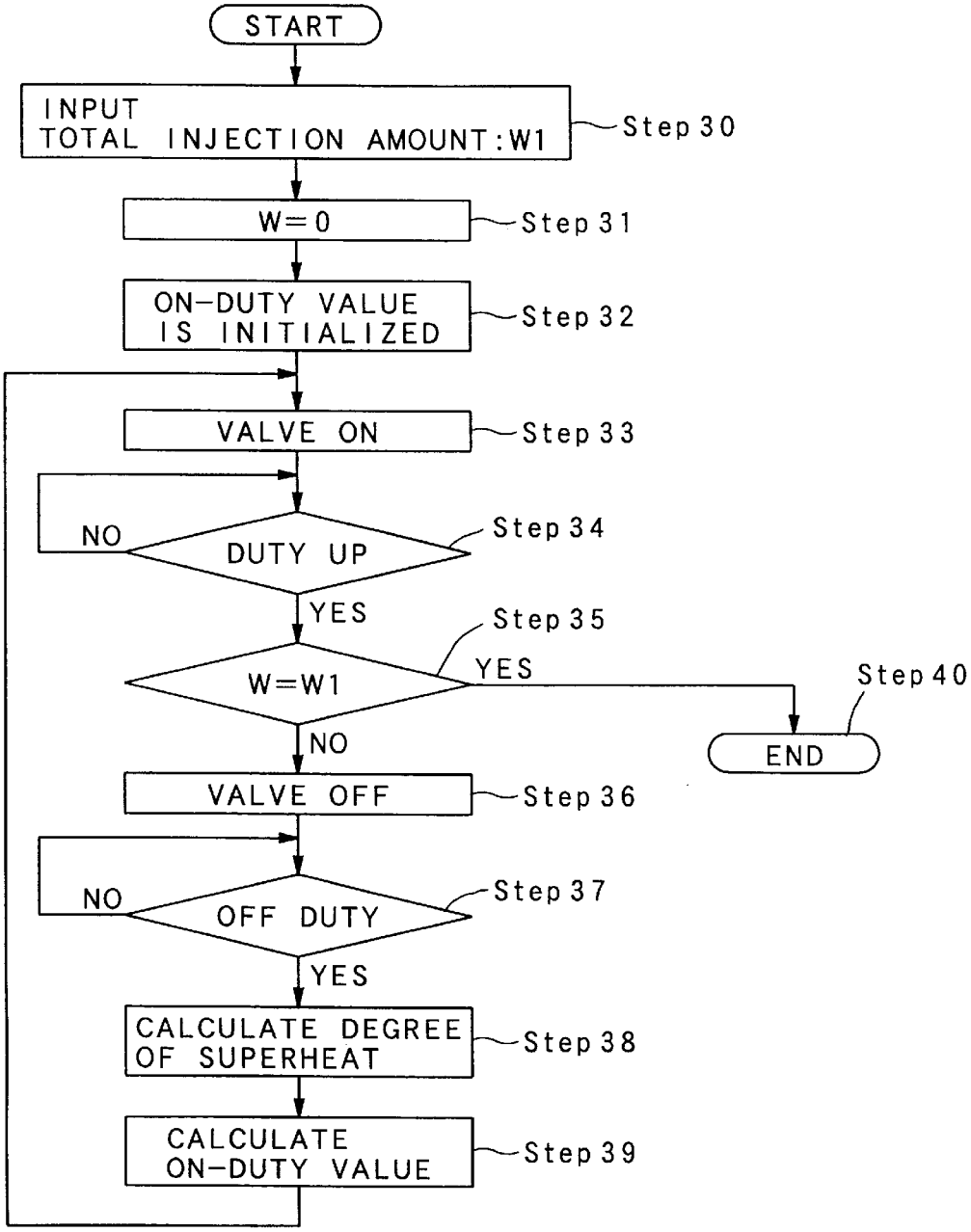
FIG. 6 is a flowchart showing an injection amount control operation based on the degree of superheat according to a third embodiment of the present invention.

FIG. 6 is a flowchart showing a refrigerant injection amount control operation according to a third embodiment of the present invention when the average injection velocity of the liquid-refrigerant to be intermittently injected into the refrigerant circuit (i.e., the ON-duty value of the electromagnetic cutoff valve) is varied on the basis of the degree of superheat of the refrigerant in the refrigeration cycle.

In this embodiment, the duty cycle of the electromagnetic valve (i.e., the duty ratio of the liquid-refrigerant injection amount per injection step (t1) and the injection time interval (T1 )) is periodically varied in accordance with the degree of superheat of the refrigerant in the refrigerant circuit to thereby vary the average injection amount of the liquid refrigerant in accordance with the degree of superheat of the refrigerant in the refrigerant circuit.

Upon the start of the operation, the demanded injection amount (total injection amount) W1 of the liquid refrigerant is input to the controller 109 as in the case of the above-described embodiments. subsequently, the liquid refrigerant injection amount W is set to "0" as an initial value in step 31. In step 32, the ON-duty value (duty ratio) is set to an initial value, and then the electromagnetic cutoff valve is switched on (opened).

In step 34, it is judged whether the time corresponding to the set ON-duty value elapses. That is, the electromagnetic cutoff valve is kept in the ON State until the time corresponding to the ON-duty valve elapses.

In step 35, it is judged whether the liquid-refrigerant injection amount W is equal to the demanded total liquid-refrigerant injection amount W1. If the judgment in step 35 is "NO", the process goes to step 36 to switch off (close) the electromagnetic cutoff valve.

In step 37, it is judged whether the time corresponding to the set OFF-duty value (1-(ON-duty)) elapses. That is, the electromagnetic cutoff valve is kept in the OFF-state until the time corresponding to the OFF-duty valve elapses. By controlling the ON-duty and the OFF-duty, the average injection amount of the liquid refrigerant at one cycle of the on/off operation of the electromagnetic cutoff valve is determined.

Subsequently, in step 38 the degree of superheat of the refrigerant in the refrigerant circuit is calculated in the same manner as described above, and the ON-duty value (duty ratio) is adjusted on the basis of the degree of superheat thus calculated. Thereafter, the electromagnetic cutoff valve is opened again to perform the liquid-refrigerant injection on the basis of the calculated ON-duty value (duty ratio). With this flow, the ON-duty value of the electromagnetic cutoff valve (i.e., the average injection velocity of the liquid refrigerant) is adjusted in accordance with the degree of superheat of the refrigerant in the refrigerant circuit.

If W=W1 in step 35, the process goes to step 40 to end the liquid-refrigerant injection amount control operation.

In the above-described embodiments, the injection amount of the liquid refrigerant is controlled by the ON/OFF-operation (opening/dosing operation) of the electromagnetic cutout valve. However, when an electric cutoff valve is used in place of the electromagnetic cutoff valve, the injection amount of the liquid refrigerant can be controlled proportionally (linearly) and more precisely by throttling back or loosening the electric cutoff valve so that the opening degree of the electric cutoff valve is set to a suitable value between the full open state and the full close state, whereby the liquid refrigerant injecting operation can be more stably performed. In this case, the "closing" of the step 24 in FIG. 5 is changed to "throttling back", and the "opening" of the step 28 in FIG. 5 is changed to "loosening (or opening)".

In the above-described embodiments, the calculation of the degree of superheat of the refrigerant is performed on the basis of the difference between the temperature of the refrigerant discharged from the compressor (i.e., detected by the sensor S1) and the saturation temperature which is calculated on the basis of the pressure S1' of the refrigerant discharged from the compressor (i.e., detected by the pressure sensor S1'). However, in place of the temperature of the discharged refrigerant, the temperature of the case of the compressor may be used (in the case of a high internal pressure type compressor). Alternatively, the degree of superheat may be calculated from the difference between the temperature of the refrigerant sucked into the compressor (i.e., detected by the sensor S2) and the saturation temperature which is calculated on the basis of the pressure of the refrigerant sucked into the compressor (i.e., detected by the sensor S2'). In this case, the temperature of the case of the compressor may be used in place of the temperature of the refrigerant sucked into the compressor (in the case of a low internal pressure type compressor).

Further, the pressure sensors are used to determine the saturation temperature of the refrigerant, however, the saturation temperature of the refrigerant discharged from or sucked into the compressor may be estimated on the basis of the outside air temperature. In this case, the temperature serving as the judgment (calculation) criterion for the degree of superheat may be varied. Further, the pressure sensor may be designed in a unit type, or a built-in type which is originally contained in the injecting apparatus itself.

As described above, according to the above-described embodiments, a large amount of liquid refrigerant can be quickly injected into the liquid refrigerant with no liquid compression in the compressor 11. Further, the controller 109 automatically injects the liquid refrigerant and stops the injection, so that the operator is not required to pay his attention to the injection work for a long time and thus the efficiency of the liquid-refrigerant injection work can be enhanced.

The present invention is not limited to the above-described embodiments, and various modifications may be made without departing from the subject matter of the present invention. For example, in the above-described embodiments, the liquid-refrigerant injection time is calculated by dividing the refrigerant injection amount per injection step (Wo) by the injection amount per unit time. However, the liquid-refrigerant injection may be directly performed on the basis of the weight variation of the refrigerant bomb. Further, the method and apparatus of the present invention may be applied to a refrigerating machine having no accumulator. In this case, it is preferable to increase the number of the injection steps and reduce the liquid-refrigerant injection amount per injection step to an extremely small value in order to perfectly vaporize the liquid refrigerant in the refrigerant circuit. Besides, the construction of the apparatus and the injection method of the liquid refrigerant may be suitably modified without departing from the subject matter of the present invention.

Further, the above-described embodiments relate to the liquid-refrigerant injection into the refrigeration circuit. However, it may be applied to refrigerant injection in a refrigerating machine such as an ice machine or the like.

As described above, according to the refrigerant injection method and apparatus according to the present invention, the liquefied nonazeotropic mixed refrigerant can be quickly injected into the refrigerant circuit while preventing the liquid compression in the compressor.

What is claimed is:

1. A method for injecting mixed refrigerant into a refrigerant circuit comprising at least a compressor, a condenser, an expansion device and an evaporator which are connected to one another through a refrigerant pipe, characterized in that the mixed refrigerant is intermittently injected from a refrigerant bomb at a predetermined position of a low pressure side of said refrigerant circuit while keeping the mixed refrigerant that is being injected in a liquid state.

2. The mixed refrigerant injection method as claimed in claim 1, wherein said refrigerant circuit contains an accumulator which is provided between said a suction port of said compressor and the predetermined position, and the intermittent injection amount of the mixed refrigerant is set to be lower than the liquid stock capacity of said accumulator on the basis of a refrigerant vaporizing capability of the mixed refrigerant.

3. The mixed refrigerant injection method as claimed in claim 2, wherein the average injection velocity of the mixed refrigerant is set to such a suitable value that the average injection velocity does not exceed the vaporization velocity of the mixed refrigerant based on the environmental temperature.

4. The mixed refrigerant injection method as claimed in claim 1, wherein the average injection velocity of the mixed refrigerant which is intermittently injected to the predetermined position in said refrigerant circuit is determined on the basis of the degree of superheat of the refrigerant in said refrigerant circuit.

5. The mixed refrigerant injection method as claimed in claim 4, wherein said refrigerant circuit contains an accumulator which is provided between said a suction port of said compressor and the predetermined position, and the average injection velocity of the mixed refrigerant is set to be lower than the refrigerant vaporizing velocity of said accumulator.

6. The mixed refrigerant injection method as claimed in claim 4, wherein the injection of the mixed refrigerant into said refrigerant circuit is performed by controlling an open/close valve on the basis of the temperature of the mixed refrigerant at a predetermined position in said refrigerant circuit.

7. The mixed refrigerant injection method as claimed in claim 6, wherein the temperature of the mixed refrigerant at the predetermined position in said refrigerant circuit corresponds to the temperature of the mixed refrigerant discharged from or sucked into said compressor.

8. The mixed refrigerant injection method as claimed in claim 1, wherein the intermittent mixed refrigerant injection is controlled on the basis of the degree of superheat of the mixed refrigerant in said refrigerant circuit.

9. The mixed refrigerant injection method as claimed in claim 8, wherein the degree of superheat of the mixed refrigerant is defined as (1) the difference between the temperature of the mixed refrigerant discharged from said compressor and the saturation temperature of the mixed refrigerant which is calculated on the basis of the pressure of the mixed refrigerant discharged from said compressor, (2) the difference between the temperature of the mixed refrigerant discharged from said compressor and the condensation temperature of the mixed refrigerant which is calculated on the basis of the outside air temperature, (3) the difference between the temperature of the mixed refrigerant sucked into said compressor and the saturation temperature of the mixed refrigerant sucked into said compressor which is calculated on the basis of the pressure of the mixed refrigerant sucked into said compressor, (4) the difference between the temperature of the mixed refrigerant sucked into said compressor and the temperature of the mixed refrigerant sucked into said compressor which is calculated on the basis of the outside air temperature, (5) the difference between the temperature of the case of said compressor and the saturation temperature of the mixed refrigerant which is calculated on the basis of the pressure of the mixed refrigerant discharged from said compressor, (6) the difference between the temperature of the case of said compressor and the condensation temperature of the mixed refrigerant which is calculated on the basis of the outside air temperature (in the case where said compressor is a high internal pressure type), (7) the difference between the temperature of the case of said compressor and the saturation temperature of the mixed refrigerant which is calculated on the basis of the pressure of the mixed refrigerant sucked into said compressor, or (8) the difference between the temperature of the case of said compressor and the temperature of the mixed refrigerant sucked into said compressor which is calculated on the outside air temperature (in the case of a low internal pressure type compressor).

10. The mixed refrigerant injection method as claimed in claim 4, wherein the degree of superheat of the mixed refrigerant is defined as (1) the difference between the temperature of the mixed refrigerant discharged from said compressor and the saturation temperature of the mixed refrigerant which is calculated on the basis of the pressure of the mixed refrigerant discharged from said compressor, (2) the difference between the temperature of the mixed refrigerant discharged from said compressor and the condensation temperature of the mixed refrigerant which is calculated on the basis of the outside air temperature, (3) the difference between the temperature of the mixed refrigerant sucked into said compressor and the saturation temperature of the mixed refrigerant sucked into said compressor which is calculated on the basis of the pressure of the mixed refrigerant sucked into said compressor, (4) the difference between the temperature of the mixed refrigerant sucked into said compressor and the temperature of the mixed refrigerant sucked into said compressor which is calculated on the basis of the outside air temperature, (5) the difference between the temperature of the case of said compressor and the saturation temperature of the mixed refrigerant which is calculated on the basis of the pressure of the mixed refrigerant discharged from said compressor, (6) the difference between the temperature of the case of said compressor and the condensation temperature of the mixed refrigerant which is calculated on the basis of the outside air temperature (in the case where said compressor is a high internal pressure type), (7) the difference between the temperature of the case of said compressor and the saturation temperature of the mixed refrigerant which is calculated on the basis of the pressure of the mixed refrigerant sucked into said compressor, or (8) the difference between the temperature of the case of said compressor and the temperature of the mixed refrigerant sucked into said compressor which is calculated on the outside air temperature (in the case of a low internal pressure type compressor).

* * * * *

UNITED STATES PATENT AND TRADEMARK OFFICE

CERTIFICATE OF CORRECTION

PATENT NO. : 5,970,721

DATED : October 26, 1999

INVENTOR(S) : Ichiro KAMIMURA

It is certified that errors appear in the above-identified patent and that said Letters Patent is hereby corrected as shown below:

Title page, [75] Inventors, please change the place of residence of first inventor.

"OIZUMI-MACHI, JAPAN" to –KASAKAKE-MACHI, JAPAN–.

Signed and Sealed this

Twenty-sixth Day of December, 2000

*Attest:*

Q. TODD DICKINSON

*Attesting Officer*

*Director of Patents and Trademarks*